US010920392B2

(12) United States Patent
Ware et al.

(10) Patent No.: US 10,920,392 B2
(45) **Date of Patent: *Feb. 16, 2021**

(54) COVER GRATE FOR WELL-SITE CELLARS

(71) Applicant: St. Peter Metal Works, LLC, Whitney, TX (US)

(72) Inventors: Joseph Ware, Kopperl, TX (US); Thomas St. Peter, Morgan, TX (US)

(73) Assignee: St. Peter Metal Works, LLC, Whitney, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/047,207

(22) Filed: Jul. 27, 2018

(65) Prior Publication Data

US 2018/0371718 A1 Dec. 27, 2018

Related U.S. Application Data

(63) Continuation-in-part of application No. 15/825,182, filed on Nov. 29, 2017.

(51) Int. Cl.
*E02D 29/14* (2006.01)

(52) U.S. Cl.
CPC ..... *E02D 29/1463* (2013.01); *E02D 29/1418* (2013.01); *E02D 29/1454* (2013.01)

(58) Field of Classification Search
CPC ..... E02D 29/1463; E02D 29/1418; E02D 29/1454; E02D 29/02; E02D 29/0266; E02D 29/0233; E02D 29/0225; E02D 29/14; E02D 29/147; E02D 5/80; E21B 41/0021; E03F 5/06; B66F 19/005
USPC ..... 210/163, 164, 165
See application file for complete search history.

(56) References Cited

U.S. PATENT DOCUMENTS 4,844,655 A * 7/1989 Aleshire ..... E03F 3/046 405/118
4,978,103 A * 12/1990 Moisan ..... B66F 15/00 254/131
6,086,758 A * 7/2000 Schilling ..... B01D 29/23 210/164
7,637,692 B1 12/2009 Rose
9,322,156 B2 * 4/2016 McInnis ..... E03F 5/0404
2008/0193217 A1 * 8/2008 Akkala ..... E03F 5/06 405/43
2016/0289912 A1 * 10/2016 Smith ..... E02D 29/14
(Continued)

FOREIGN PATENT DOCUMENTS

WO WO-2015118286 A1 * 8/2015 ..... E03F 3/04
WO WO-2015/173630 A1 * 11/2015 ..... E02D 29/14

OTHER PUBLICATIONS

Office Action dated Jul. 16, 2020 from corresponding U.S. Appl. No. 15/825,182.

(Continued)

*Primary Examiner* — Claire A Norris
*Assistant Examiner* — Ekandra S. Miller-Cruz
(74) *Attorney, Agent, or Firm* — James E. Walton

(57) ABSTRACT

A system and method for protecting workers, vehicles, and well-heads by enclosing well-site cellars with a series of framed plates. Each plate is perforated and configured for lifting with holes for hoisting the plates. Each plate is lipped to be retained by longitudinal edges of the cellar. A plurality of plates supports a platform for supporting a pipe wrangler adjacent a cellar based wellbore.

7 Claims, 13 Drawing Sheets

(56) References Cited

U.S. PATENT DOCUMENTS

2017/0241145 A1* 8/2017 Gomo ..... B66B 13/301
2017/0284077 A1* 10/2017 Deurloo ..... A01M 23/08

OTHER PUBLICATIONS

Request for Continued Examination filed Jun. 5, 2020 in corresponding U.S. Appl. No. 15/825,182.

* cited by examiner

COVER GRATE FOR WELL-SITE CELLARS

BACKGROUND

1. Field of the Invention

The present invention relates generally to cover for oil wells, and more specifically to a cover grate for well-site cellars such as the Cellar Tech containment well cellar having a lip.

2. Description of Related Art

Conventional well sites for hydrocarbon extraction from the ground are flush with or above ground. In order to prevent accidents, some drill sites locate the well head below grade to prevent accidents in a concrete or steel cellar. Well heads below grade are grouped together in a rectangular cellar below the pad site. Conventional systems, if any are used to prevent accidentally falling into the cellars, consist of removable railings that slip into the perimeter of the cellar. These railings are cumbersome to operators as they stick out of the ground. Thus, there exists significant room for improvement in the art for overcoming these and other shortcomings of conventional systems and methods for closing in cellars for oil field operations.

DESCRIPTION OF THE DRAWINGS

The novel features believed a characteristic of the embodiments of the present application is set forth in the appended claims. However, the embodiments themselves, as well as a preferred mode of use, and further objectives and advantages thereof will best be understood by reference to the following detailed description when read in conjunction with the accompanying drawings, wherein:

Figure 1:
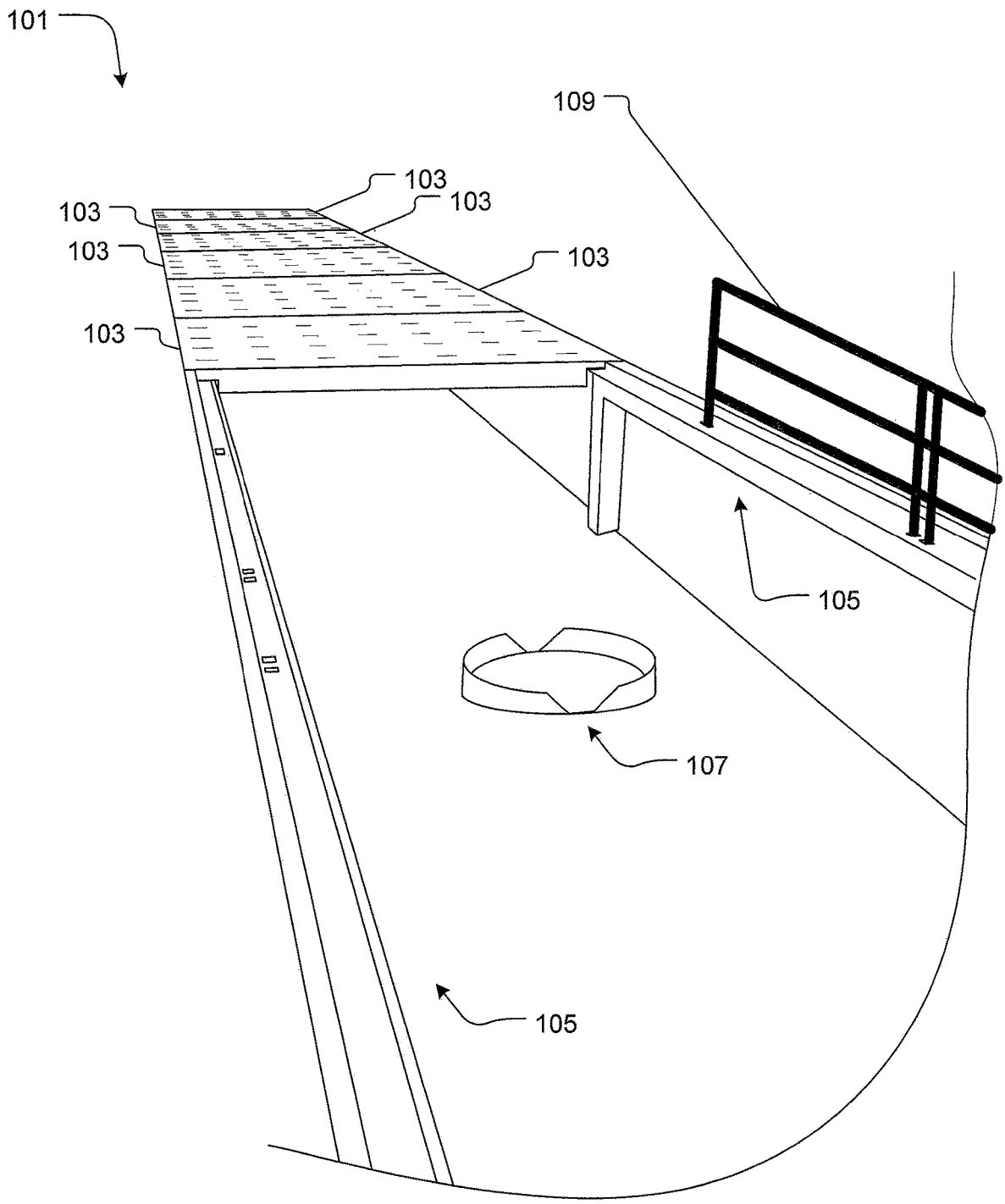
FIG. 1 is a perspective view of a well-site cellar partially covered with grates according to the present application.

While the assembly and method of the present application are susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the cover grate for well-site cellars are provided below. It will, of course, be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

A cover grate specifically configured for closing out Cellar Tech type cellars provide features not found in conventional covers. Cellar Tech style containment well cellars feature structural reinforcements along with sealed seams preventing migration of fluids from inside the cellar to outside the cellar and vice versa. Furthermore, containment well cellars feature inwardly facing lips near the opening for preventing runoff rainwater and other fluids from entering the opening. The improved cover grating utilizes the lip of the containment well cellar to hold the improved cover grating adjacent the opening.

Referring now to FIG. 1 in the drawings, a preferred embodiment of a plurality of cover grates for well-site cellars according to the present application is illustrated. System 101 is comprised of a plurality of cover grates 103, fabricated of steel, retained by a pair of longitudinal lips 105 of a well-site cellar. The cover grates are located above the cellar and not configured to be located below grade and inside the cellar. Each cover grate is comprised of a perforated top plate supported by a frame. The user can vary the number of cover grates required to close as much of the well site cellar as required to access the well head 107. Conventional fencing 109 is retained by openings in the longitudinal edges 105 of the well-site cellar. Cover grates 103 covers openings in the lips 105 for conventional fencing 109. Each grate of the system is oriented to be parallel to the sides of the cellar so that the grating can translate a length of the cellar depending upon where the cover is required. The cover is structurally designed to support the movement of equipment and personnel around the cellar on the cover grate, however, vehicles are restricted from driving across the plurality of grate covers. Each cover grate is designed to support 1,000/lbs/ft$^2$ evenly distributed across the grate.

Figure 2:
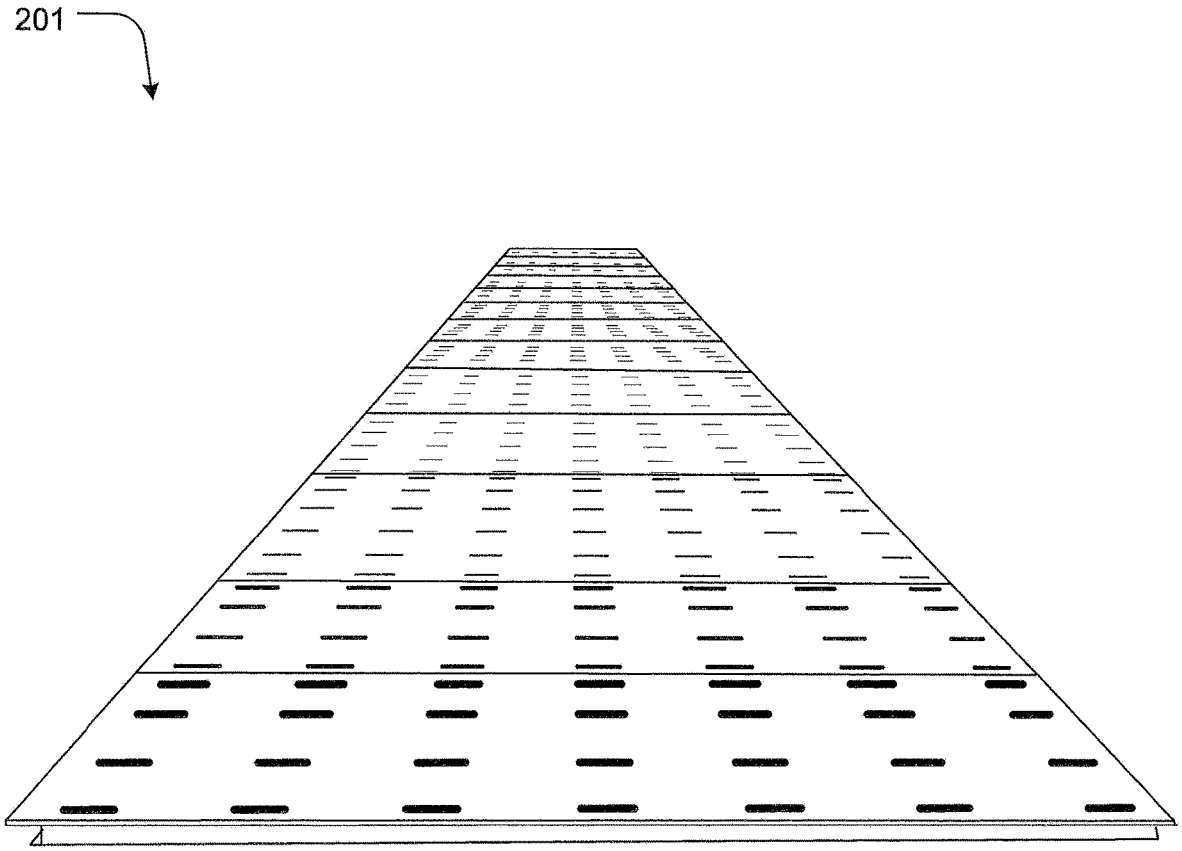
FIG. 2 is a perspective view of a well-site cellar completely covered with grates according to the present application.
Figure 3A:
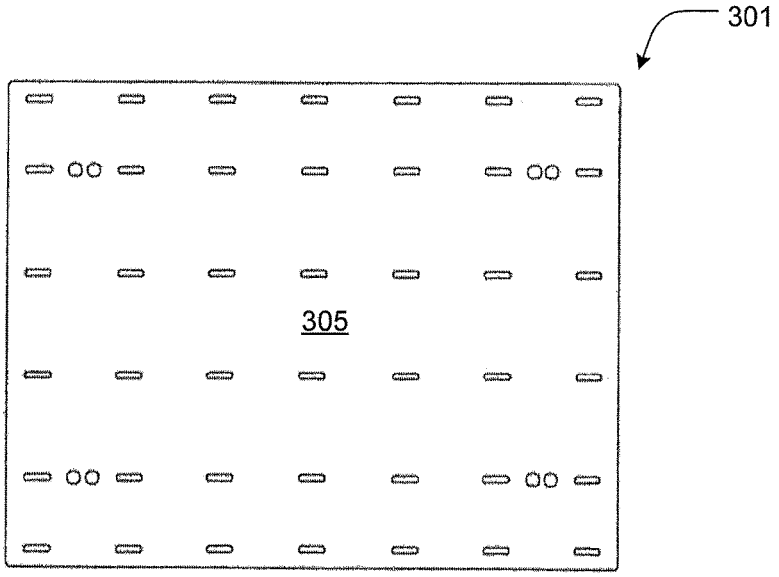
FIG. 3A is a top view of a cover grate for a well site cellar according to the present application.
Figure 3D:
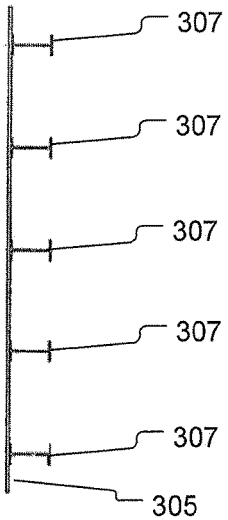
FIG. 3D is a section view along a line IIID of a cover grate for a well site cellar according to the present application.
Figure 3B:
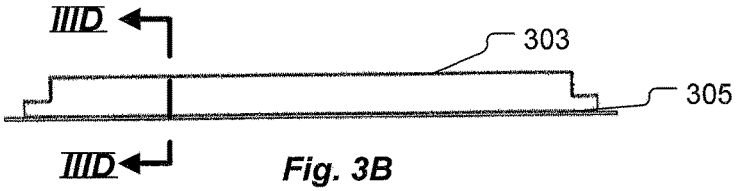
FIG. 3B is a side view of a cover grate for a well site cellar according to the present application.
Figure 3C:
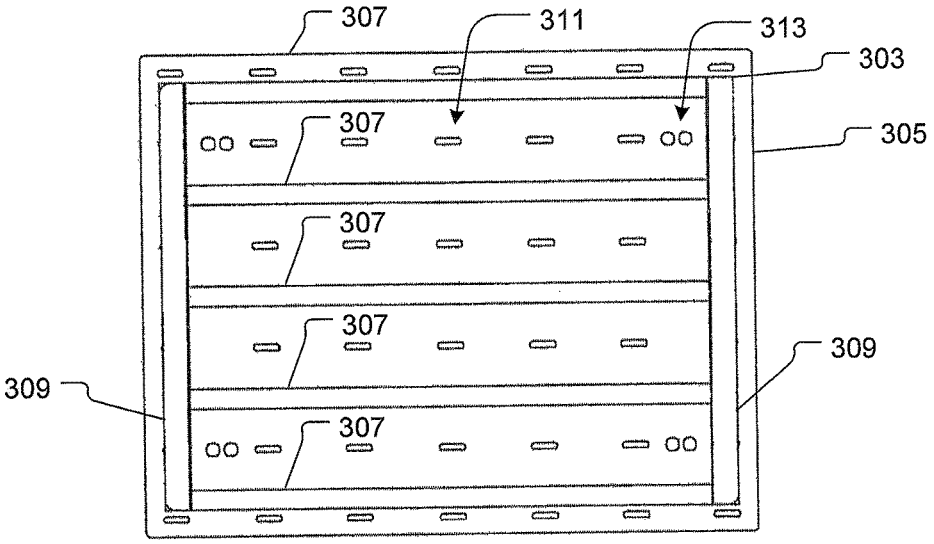
FIG. 3C is a bottom view of a cover grate for a well site cellar according to the present application.
Figure 4A:
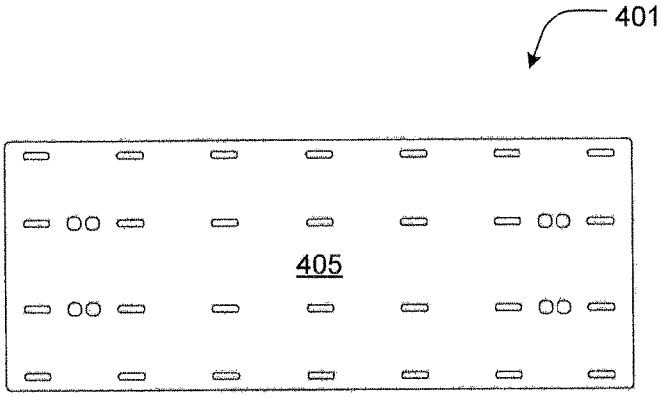
FIG. 4A is a top view of a cover grate for a well site cellar according to the present application.
Figure 4D:
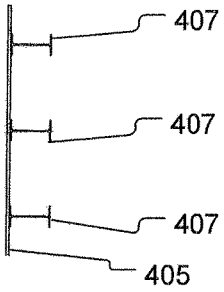
FIG. 4D is a section view along a line IIID of a cover grate for a well site cellar according to the present application.
Figure 4B:
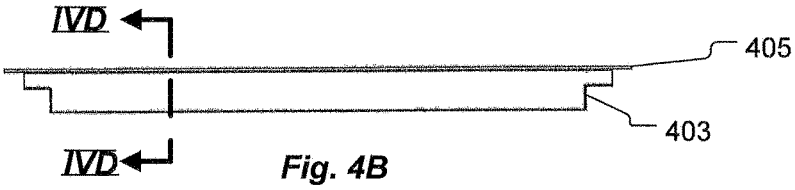
FIG. 4B is a side view of a cover grate for a well site cellar according to the present application.
Figure 4C:
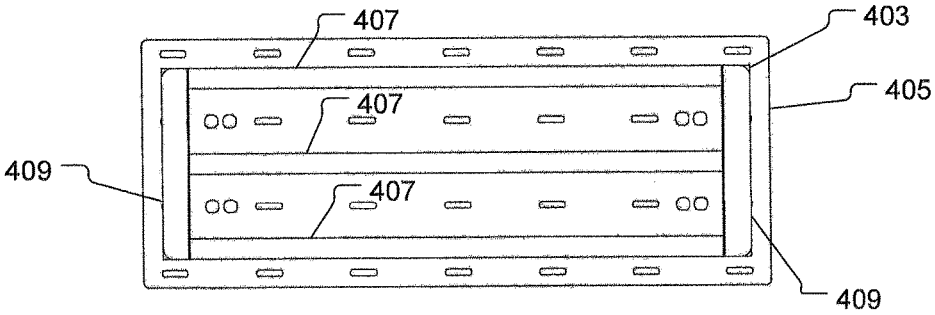
FIG. 4C is a bottom view of a cover grate for a well site cellar according to the present application.

Referring now also to FIG. 2 in the drawings, a preferred embodiment of a plurality of cover grates completely covering a well-site cellar according to the present application is illustrated. System 201 is similar to that of system 101 and further secures the well site by completely covering the well-site cellar from end to end.

Referring now also to FIGS. 3A-3D in the drawings, a preferred embodiment of a cover grate according to the present application is illustrated. Cover grate 301 is comprised of a frame 303 and a plate 305. Preferably plate 305 is welded to frame 303, however other alternative embodiments feature fasteners to rigidly couple the plate and frame together. Frame 303 is comprised of a first plurality of support members 307 and a second plurality of support members 309. The first plurality of support members 307 are spaced across the plate and capped on the ends by the second plurality of support members 309 to form frame 303. Each member of the second plurality of support members 309 is configured to be retained by the longitudinal edges of the cellar by being notched. Notching the second plurality of support members allows the cover to be inserted into the cellar and removed from the cellar by lifting and setting the grating vertically. Alternative embodiments utilize a different profile for the second plurality of support members where the cover is inserted and then horizontally translated into a locked position on the cellar. The first plurality of support members is comprised of a series of evenly spaced I-beams.

Plate 305 is comprised of a first array of openings 311 and a second array of openings 313. The first array of openings 311 are oblong to retain legs of supporting platforms, Furthermore, the first array of openings are configured to allow migration of light, gas, and liquids from a top of the cover to the contents of the cellar. While illustrated as the cover being mostly solid, it should be apparent that the cover grate 301 alternatively be mostly perforated and open between above and below the cover grate. The second array of openings 313 are pairs of collocated circular openings configured to allow the grate to be picked up and lowered by a chain and/or a hook.

Referring now also to FIGS. 4A-4D in the drawings, an alternative embodiment of a cover grate according to the present application is illustrated. Cover grate 401 is comprised of a frame 403 and a plate 405. Frame 403 is comprised of a first plurality of support members 407 and a second plurality of support members 409. Cover grate 401 is shorter in length than cover grate 301 and provides users with more flexibility to cover well-site cellars.

Figure 5A:
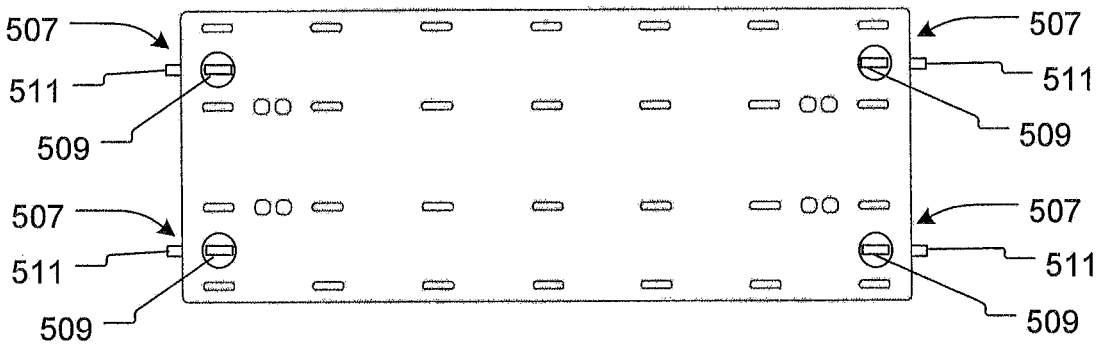
FIG. 5A is a top view of an alternative cover grate for a well site cellar according to the present application.
Figure 5B:
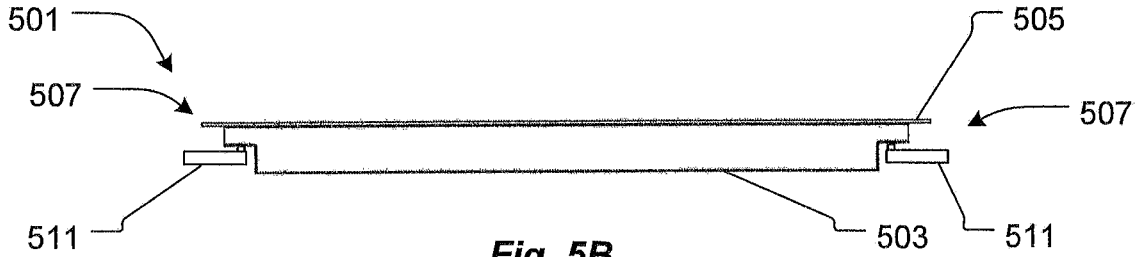
FIG. 5B is a side view of an alternative cover grate for a well site cellar according to the present application.

Referring now also to FIGS. 5A-5B in the drawings, an alternative embodiment of a cover grate according to the present application is illustrated. Cover grate 501 is comprised of a frame 503, a plate 505, and locking members 507. Locking members 507 is comprised of a recessed handle 509 accessible from the top of the grate after installation and a pivoting member 511 rotationally coupled to the handle 509. Once the cover grate 501 is installed on the cellar, the user rotates handles 509 thereby rotating pivoting members underneath a lip or edge of the cellar. The pivoting member being under the edge of the cellar prevents the grating from being lifted. Alternative cover grate 501 further comprises a plurality of fasteners for positively retaining the grates to the lips of the cellar. Furthermore, alternative embodiments of the grating feature manholes covers, ladders, and lighting for access above and below the cover grate.

Figure 6:
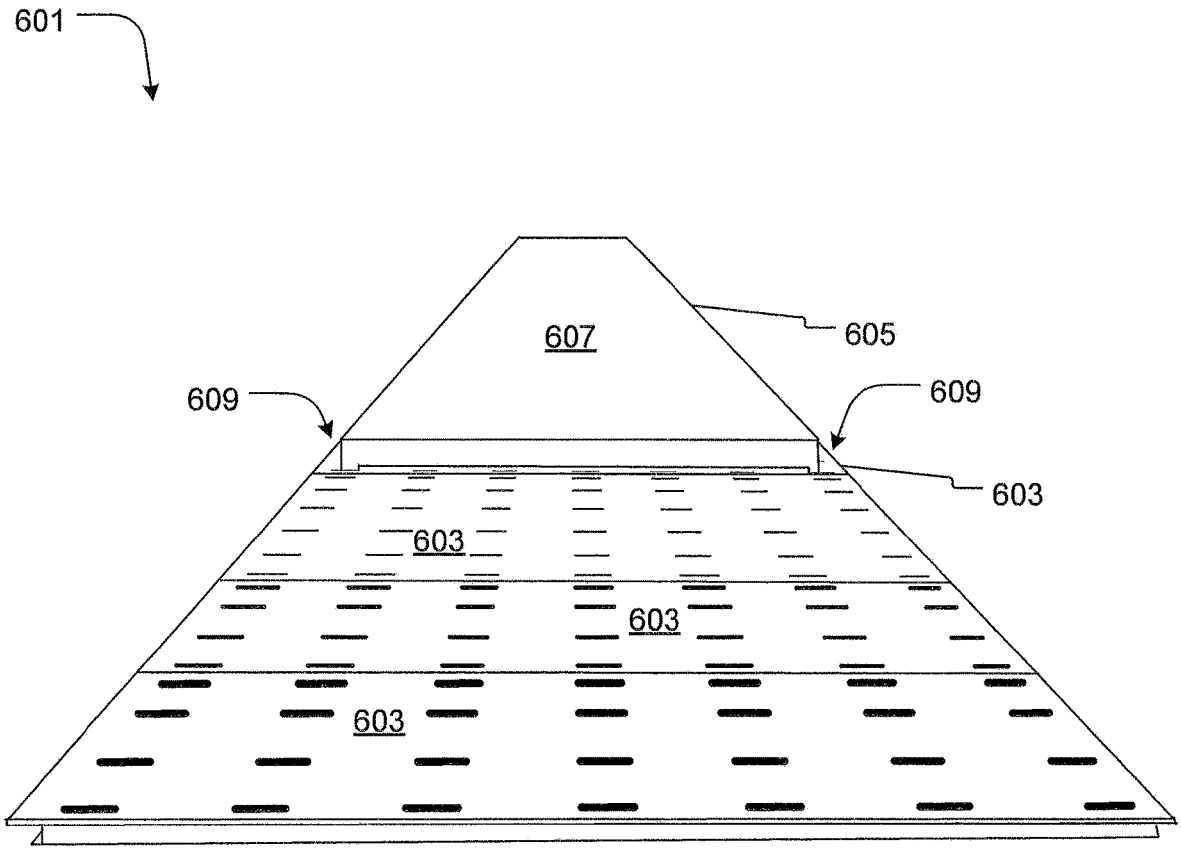
FIG. 6 is a perspective view of a well-site cellar completely covered with grates supporting a platform for a pipe wrangler according to the present application.

Referring now also to FIG. 6 in the drawings, a preferred embodiment of a plurality of cover grates completely covering a well-site cellar according to the present application is illustrated. System 601 is similar to that of system 201 and further secures the well site by completely covering the well-site cellar from end to end. System 601 is comprised of a plurality of grate covers 603 supporting a platform 605 for a pipe wrangler (not shown). The platform 605 is comprised of a flat upper plate 607 and a plurality of legs 609 having an oblong profile. Each of the legs 609 is received by an oblong opening in the grate covers. Platform 605 is moved by a crane by strapping underneath the flat upper plate 607. Alternatively, platform 605 further comprises a plurality of lifting points arrayed across the top of the platform.

The platform 605 is rigidly retained by the grate covers 603 thereby translation between the grate covers and the platform 605 is inhibited. Furthermore, translation between the platform 605 and the ground is inhibited because the grate covers 603 are retained by the lips of the cellar. The platform being retained by the grate covers is assisted by the friction associated with the platform weighing several thousand pounds.

Figure 7:
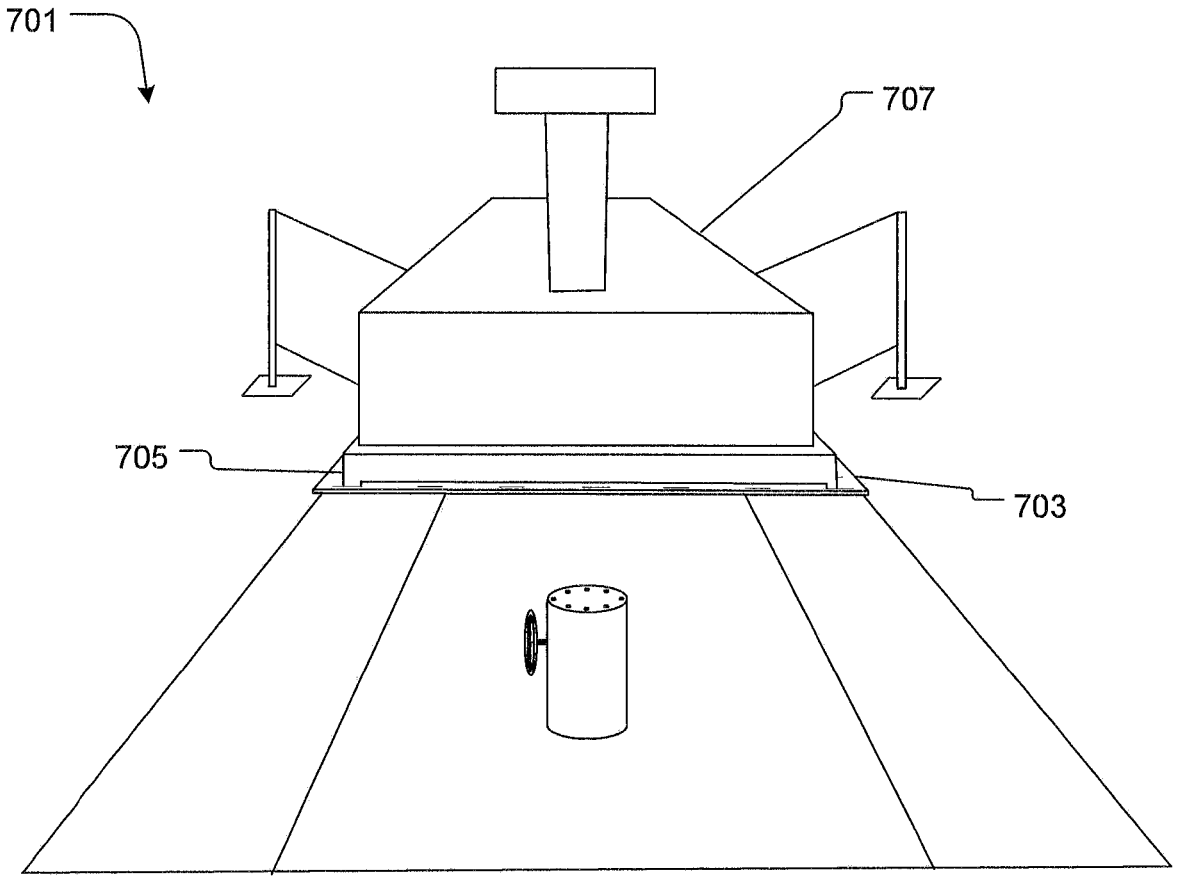
FIG. 7 is a perspective view of a well-site cellar partially covered with grates supporting a platform for a pipe wrangler according to the present application.

Referring now also to FIG. 7 in the drawings, a preferred embodiment of a plurality of cover grates partially covering a well-site cellar according to the present application is illustrated. System 701 is similar to that of system 601 and further secures the well site by partially covering the well-site cellar while leaving an opening for a well head Christmas tree. System 701 is comprised of a plurality of grate covers 703 supporting a platform 705 for a pipe wrangler 707.

Figure 8:
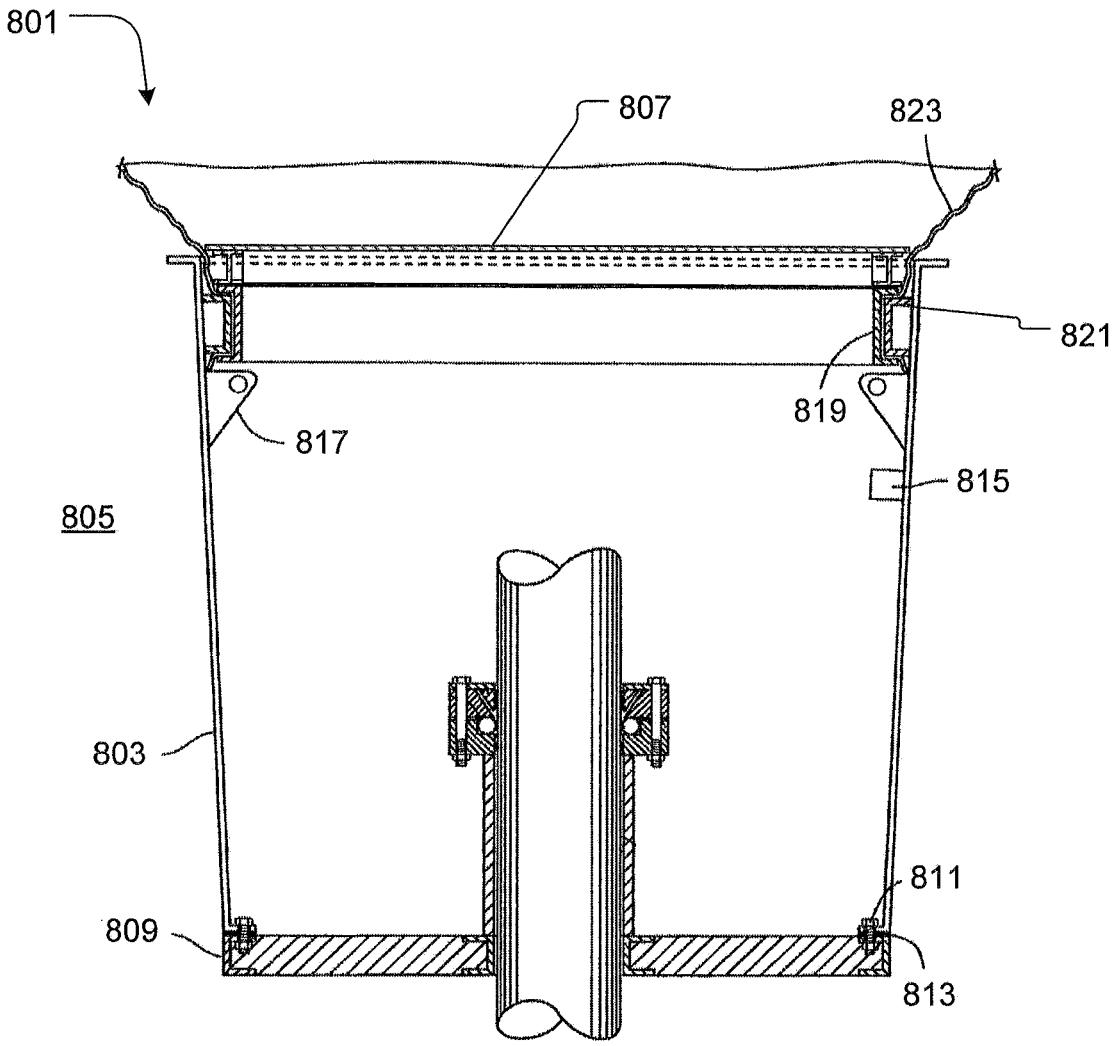
FIG. 8 is a section view of a well-site cellar covered with a cover grate.

Referring now also to FIG. 8 in the drawings, an alternative embodiment of a cover grates covering a well-site cellar according to the present application is illustrated. System 801 is comprised of a Cellar Tech type containment well cellar 803 sunken into the ground 805 and a grate cover 807. While the illustrated as a cellar that is assembled on site, it should be apparent that the improved cellar grates may be used with a preassembled containment cellar that is trucked to the well site and hoisted into place. Cellar 803 is comprised a plurality of sides coupled to a bottom 809 by fasteners 811 with a seal 813 between the plurality of sides and the bottom 809. Furthermore, high water sensor 815 is located on a side of the cellar 803 and allows users to monitor for high water. Gussets 817 are located around the cellar 803 and allow the cellar to be hoisted by a crane. Grate cover 807 rests on top of a hoop 819 and a lip 821 that retains a liner 823. Alternatively, the system 801 doesn't use a liner 823 and doesn't have a hoop 819 such that the grate cover 807 rests directly on top of the lip 821.

Figure 9:
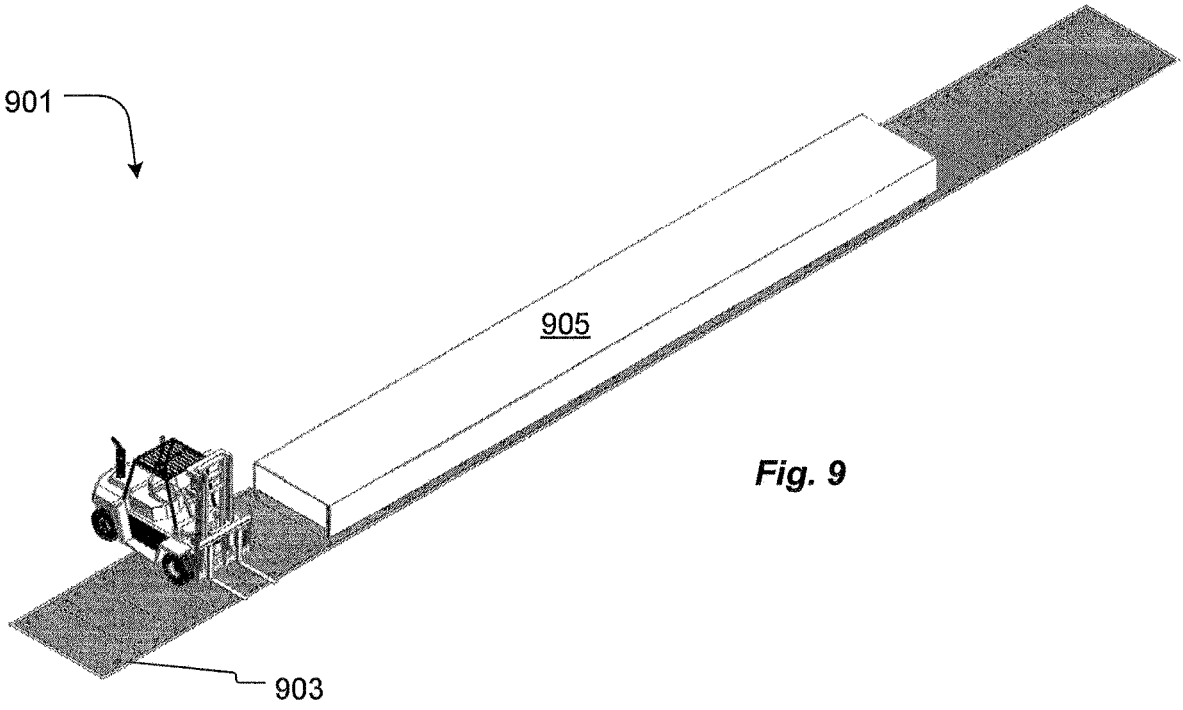
FIG. 9 is a perspective view of a well-site cellar completely covered with grates supporting a platform for a pipe wrangler along with a forklift according to the present application.

Referring now also to FIG. 9 in the drawings, an alternative embodiment of a plurality of cover grates partially covering a well-site cellar according to the present application is illustrated. System 901 is similar to that of system 601 and further secures the well site by partially covering the well-site cellar. System 901 is comprised of a plurality of grate covers 903 supporting a platform 905. System 901 is strong enough to support a forklift driving over the well-site cellar.

Figure 10A:
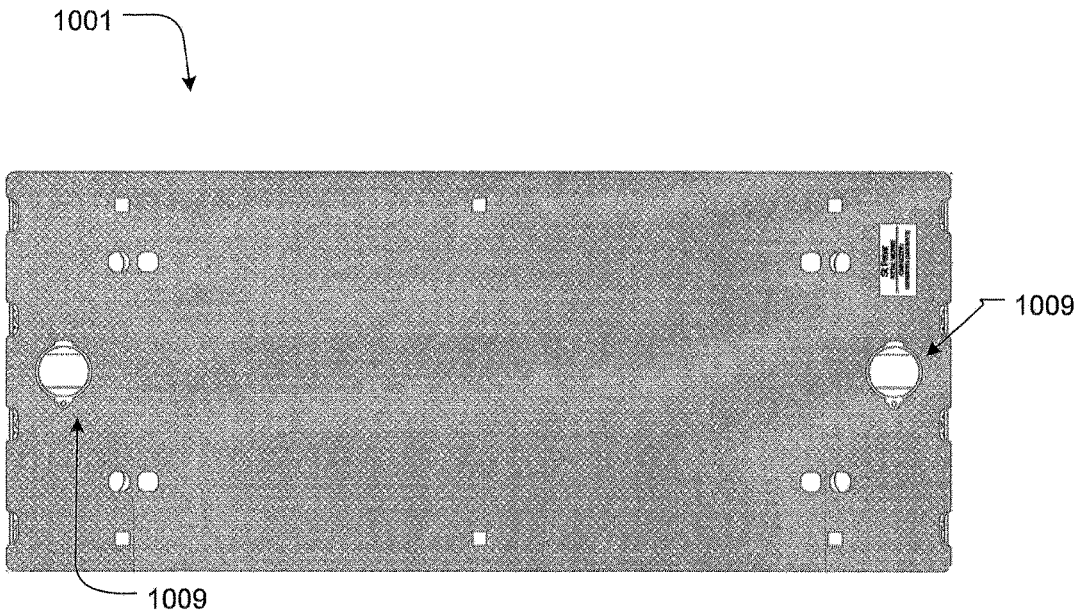
FIG. 10A is a top view of a cover grate for a well site cellar according to the present application.
Figure 10B:
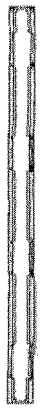
FIG. 10B is an end view of a cover grate for a well site cellar according to the present application.
Figure 10C:
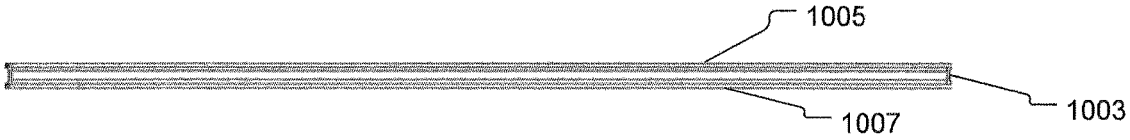
FIG. 10C is a side view of a cover grate for a well site cellar according to the present application.
Figure 11A:
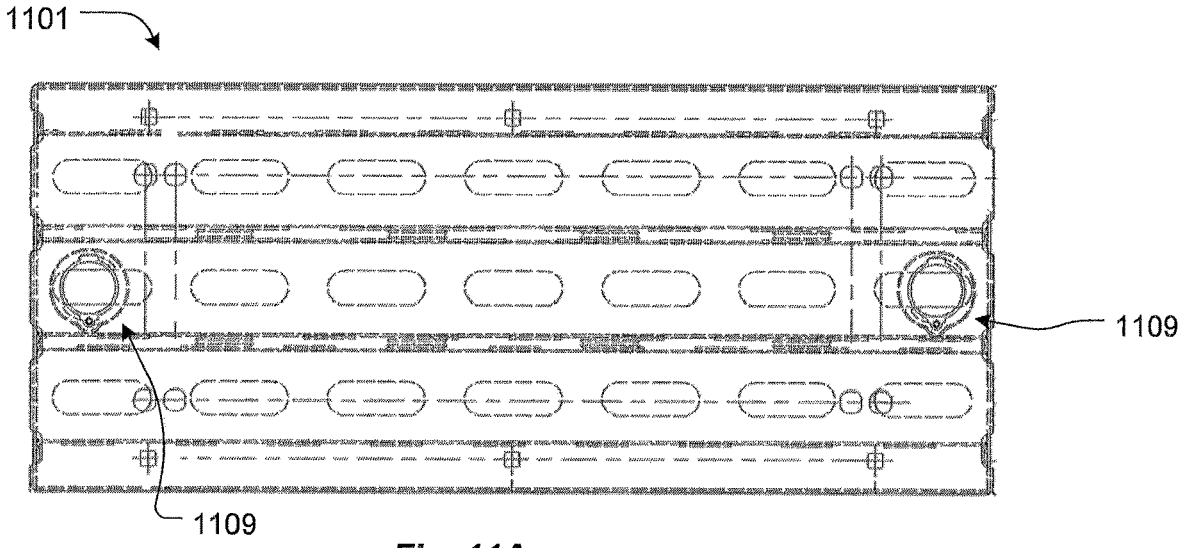
FIG. 11A is a bottom view of a cover grate for a well site cellar according to the present application.
Figure 11B:
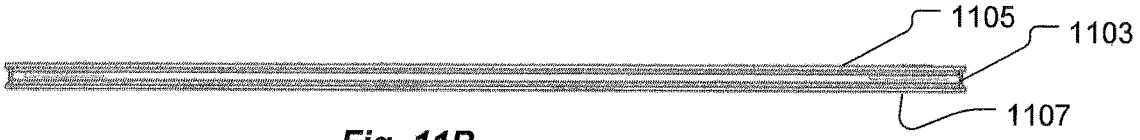
FIG. 11B is a side view of a cover grate for a well site cellar according to the present application.
Figure 11C:
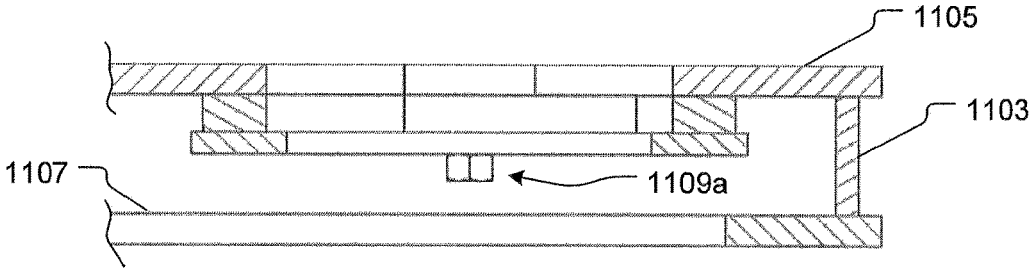
FIG. 11C is a partial enlarged section view of a cover grate for a well site cellar according to the present application.
Figure 11D:
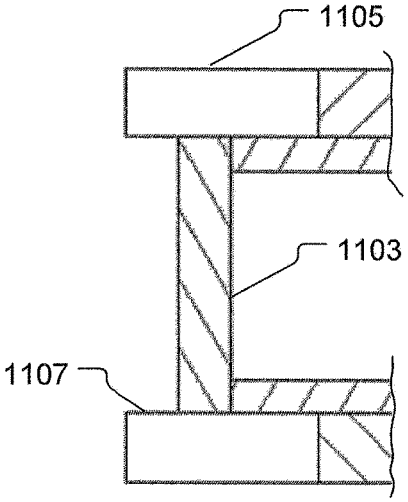
FIG. 11D is a partial enlarged section view of a cover grate for a well site cellar according to the present application.
Figure 11E:
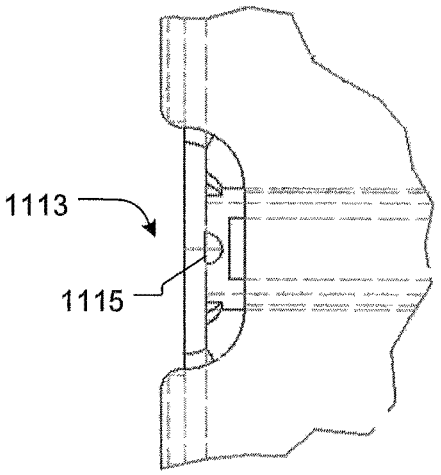
FIG. 11E is an enlarged partial view of a cover grate for a well site cellar according to the present application.

Referring now also to FIGS. 10A-10C in the drawings, an alternative embodiment of a cover grate according to the present application is illustrated. Cover grate 1001 is comprised of a frame 1003, a first plate 1005, and a second plate 1007. Preferably plates 1005 1007 are welded to frame 1003, however other alternative embodiments feature fasteners to rigidly couple the plate and frame together. Cover 1001 further comprises a pair of openings 1009 for pass through the cover grate. Each of the openings 1009 acts as an access port and allows users to reach underneath the cover grate as needed without lifting and moving the cover grate. Openings 1009 can be closed with flush plugs to prevent a foot falling into the opening. While the preferred location of openings 1009 is located centered near each end of the cover grate, other locations are contemplated by this application.

Referring now also to FIGS. 11A-11E in the drawings, an alternative embodiment of a cover grate according to the present application is illustrated. Cover grate 1101 is comprised of a frame 1103, a first plate 1105, and a second plate 1107. Preferably plates 1105 1107 are welded to frame 1103, however other alternative embodiments feature fasteners to rigidly couple the plate and frame together. Cover 1101 further comprises a pair of openings 1109 for pass through the cover grate. Each of the openings 1109 acts as an access port and allows users to reach underneath the cover grate as needed without lifting and moving the cover grate. Openings 1109 can be closed with plugs to prevent a foot falling into the opening. Located adjacent to openings 1109 are locations for fasteners to be installed, such as a bolt, to preclude the plug from being removed or installed. Nut 1109*a* is located between the first plate 1105 and the second plate 1107 to secure the fastener.

Located between the first plate 1005 and the second plate is a pair of cover retention elements 1111 centered around the openings 1109 and to rigidly secure the nut 1109*a* because of a lack of access between the plates. Furthermore, notches 1113 are located on the ends of the cover grate. Notches 1113 provide access to weep holes 1115 and allow humidity from between the plates to escape.

Figure 12A:
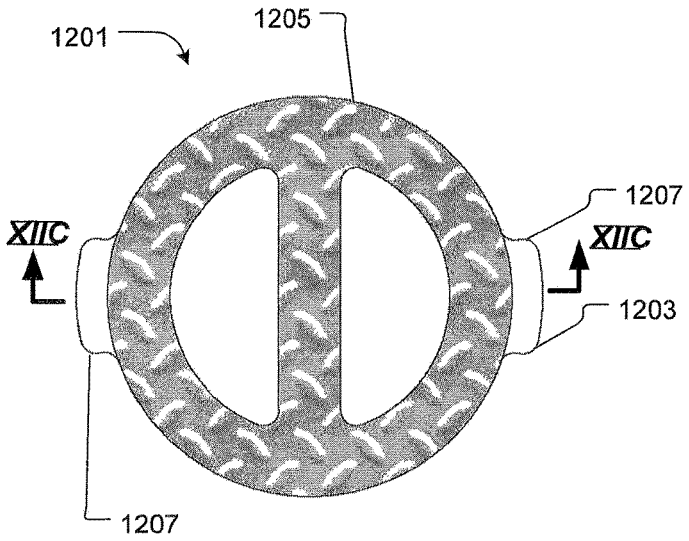
FIG. 12A is a top view of a cover grate plug for a well site cellar according to the present application.
Figure 12B:
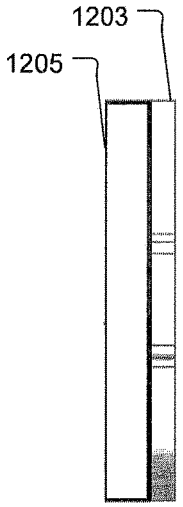
FIG. 12B is an end view of a cover grate plug for a well site cellar according to the present application.
Figure 12C:
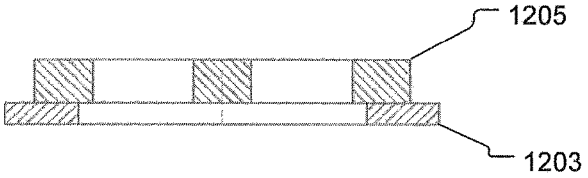
FIG. 12C is a side view of a cover grate plug for a well site cellar according to the present application.

Referring now also to FIGS. 12A-12C in the drawings, an alternative embodiment of a cover grate plug according to the present application is illustrated. Plug 1201 is configured for closing the access port through the cover grate. Plug 1201 is comprised of a first member 1203 rigidly attached to second member 1205. Second member 1205 is preferable the same material as first plate. Plug 1202 is configured to be inserted into the access port and rotated so that ears 1207 of first member are retained by the cover grate.

Figure 13A:
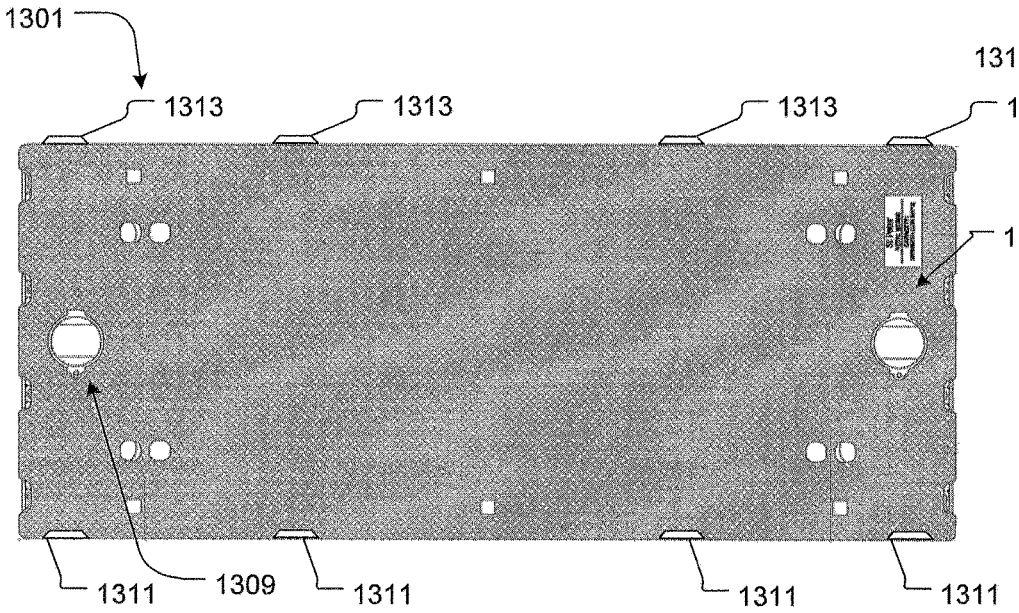
FIG. 13A is a top view of a cover grate for a well site cellar according to the present application.
Figure 13B:
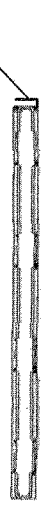
FIG. 13B is an end view of a cover grate for a well site cellar according to the present application.
Figure 13C:
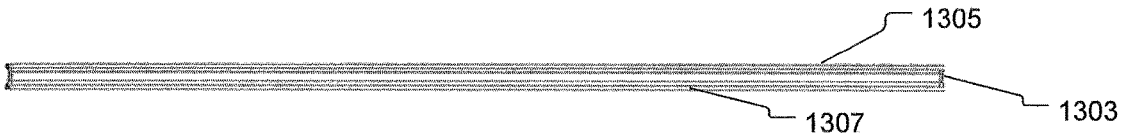
FIG. 13C is a side view of a cover grate for a well site cellar according to the present application.

Referring now also to FIGS. 13A-13C in the drawings, an alternative embodiment of a cover grate according to the present application is illustrated. Cover grate 1301 is comprised of a frame 1303, a first plate 1305, and a second plate 1307. Preferably plates 1305 1307 are welded to frame 1003, however other alternative embodiments feature fasteners to rigidly couple the plates and frame together. Cover 1101 further comprises a pair of openings 1309 for pass through the cover grate. Cover 1301 further comprises a plurality of openings 1311 located near a longitudinal edge of the cover grate. Cover 1301 further comprises a plurality of hooks 1313 located near a longitudinal edge of the cover grate opposite the longitudinal edge having the plurality of openings 1311. Cover grate 1301 is able to be coupled to adjacently located cover grates by inserting the plurality of hooks from a first cover grate into the plurality of openings from a second grate.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments but are amenable to various changes and modifications without departing from the spirit thereof.

What is claimed is:

1. A cover grate for a well-site cellar, comprising:
- a frame;
- a first plate located on a first side of the frame;
- a second plate located on a second side of the frame;
- at least one opening that is collinearly aligned through the frame, the first plate, and the second plate; and
- a plug sized to fit entirely within the at least one opening;
- wherein the first plate and the second plate are substantially similar in size;
- wherein the at least one opening is flush with the first plate and the second plate;
- wherein the at least one opening is configured to allow a user to access underneath the cover grate while the cover grate is installed on the well-site cellar; and
- wherein the plug is secured between the first plate and the second plate by a fastener, wherein the plug is removable by rotation.

2. The cover grate according to claim 1, the frame comprising:
- a first plurality of support members in a first orientation; and
- a second plurality of support members in a second orientation.

3. The cover grate according to claim 2, wherein the frame is configured to rest on lips of the well-site cellar.

4. The cover grate according to claim 1, wherein the first plate is configured for lifting by a crane.

5. The cover grate according to claim 1, wherein the plug is configured for sealing the at least one opening; and
- wherein the plug is secured between the first plate and the second plate by ¼ turn.

6. The cover grate system according to claim 1, comprising:
- wherein the fastener is received adjacent the at least one opening to prevent the plug from being removed from the first plate.

7. The cover grate according to claim 6, further comprising:

a nut;

wherein the nut secures the fastener between the first plate and the second plate to secure the plug; and wherein the nut is removable to remove the fastener and thereby remove the plug.

* * * * *